US006457709B1

(12) United States Patent
Madsen et al.

(10) Patent No.: US 6,457,709 B1
(45) Date of Patent: Oct. 1, 2002

(54) METHOD AND APPARATUS FOR AUTOMATICALLY SELF-CENTERING ENDLESS BELTS

(75) Inventors: Jeffrey C. Madsen; Wade A. Powell, both of Vancouver, WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 09/705,311

(22) Filed: Nov. 3, 2000

(51) Int. Cl.[7] ..... B65H 5/02

(52) U.S. Cl. ..... 271/275; 271/198; 148/806; 399/303

(58) Field of Search ..... 271/7, 275, 198, 271/200, 226, 241; 198/806, 840; 399/303, 312

(56) References Cited

U.S. PATENT DOCUMENTS 3,540,571 A * 11/1970 Motse et al. ..... 198/806
3,715,027 A * 2/1973 Fujimoto ..... 198/806
4,337,598 A 7/1982 Barth et al.
4,547,059 A * 10/1985 Nagayama et al. ..... 198/806
4,629,061 A 12/1986 Crandall
5,467,171 A * 11/1995 Castelli et al. ..... 198/806
5,471,289 A * 11/1995 Satoh et al. ..... 198/806
5,479,241 A 12/1995 Hou et al.
5,659,851 A 8/1997 Moe et al.
5,991,575 A * 11/1999 Okiyama et al. ..... 198/806
6,088,558 A * 7/2000 Yamada et al. ..... 198/806

FOREIGN PATENT DOCUMENTS

JP 0226433 * 10/1986 ..... 271/275

* cited by examiner

*Primary Examiner*—H. Grant Skaggs

(57) ABSTRACT

A media transport belt assembly has a continuous belt encompassing two rollers supported on a frame. A tension mechanism biases the rollers apart to generate tension in the belt. The end of one roller moves in response to increased belt tension to skew the first roller with respect to the second roller. The roller end may be pivotally attached to a frame for movement in an arc, or may be otherwise constrained to displace the roller from the plane of the belt.

10 Claims, 3 Drawing Sheets

METHOD AND APPARATUS FOR AUTOMATICALLY SELF-CENTERING ENDLESS BELTS

FIELD OF INVENTION

This invention relates to belt operated media transport mechanisms, and particularly to computer printers, copiers, and the like.

BACKGROUND AND SUMMARY OF INVENTION

Endless belts are common components in many different types of equipment. In such systems, a belt cycled over rollers generally needs to be steered or positioned on the rollers, i.e., lateral movement of the belt needs to be restrained, otherwise the belt will move partially or completely off the rollers during repeated cycling. Even when rollers are perfectly cylindrical, and a belt has a perfectly uniform circumference across its entire width, from edge to edge, belt centering is required. For imperfect components, centering is even more critical.

Conventional methods used to position belts include "active steering" and "passive steering." Active steering is a sensing device that feeds position information back to a steering roller. The steering roller then produces a change in the mechanism to produce a steering effect on the belt to correct for any deviation from the desired position. Devices to accomplish this tend to be complicated and/or costly, requiring an electronic control system to monitor feedback, to determine the required adjustment, and to make the required adjustment.

In addition, known active systems operate to divert the belt as it reaches a limit of excursion, so that the lateral position of the actively steered belt may vary unpredictably between established limits, and may undergo abrupt changes in lateral position as the limit is reached. This may be unsuitable for printers and other document generating equipment employing belts for carrying media or images for transfer to media, because abrupt lateral movements may impair image quality.

Passive steering is accomplished with a mechanism that biases the belt to a known and fixed position, or has guides that limit lateral excursion of the belt. The belt can be guided or limited by a flange on the roller or by another a stationary guide. This leads, however, to the eventual failure of the belt by wearing and cracking at the belt side edges that rub or press against the guides.

Non-metallic and other flexible or elastic belts can also be passively steered by "crowning" one or more of the pulleys, which inherently centers the belt. However, this option will not work with metal and other inelastic or minimally flexible belts without deforming the belt material.

The present invention overcomes the limitations of the prior art by providing a media transport belt assembly. The assembly has a continuous belt encompassing two rollers supported on a frame. A tension mechanism biases the rollers apart to generate tension in the belt. One end of one roller moves in response to increased belt tension to rotate the first roller's axis of rotation with respect to that of the second roller in a direction transverse to the plane of the belt. The roller end may be pivotally attached to a frame for movement in an arc, or may be otherwise constrained to allow motion in this direction.

DETAILED DESCRIPTION OF A PREFERRED EMBODIMENT

Figure 1:
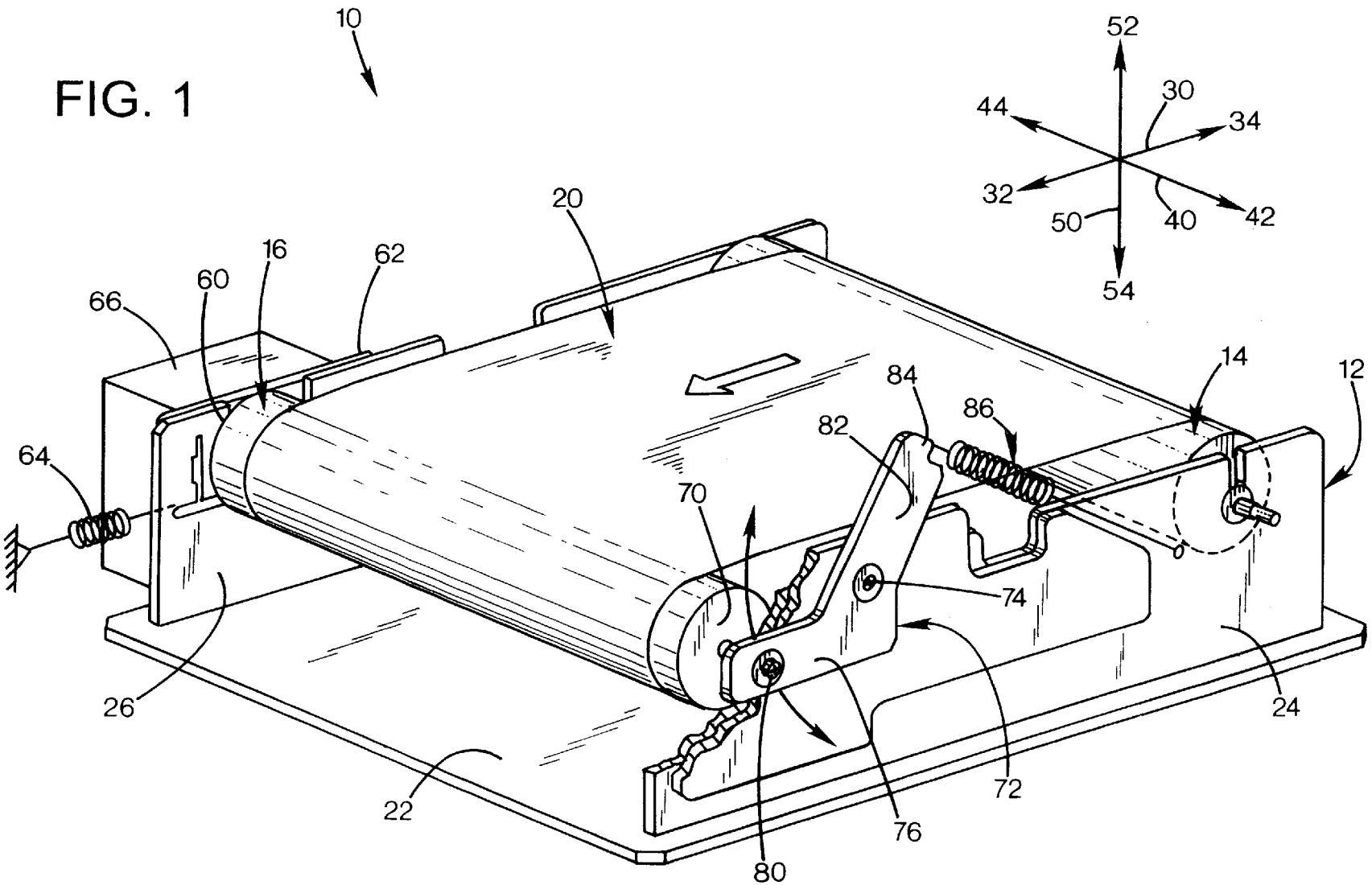
FIG. 1 is a perspective view of a belt assembly according to a preferred embodiment of the invention.

FIG. 1 shows a belt assembly 10 having a rigid frame 12 supporting a pair of rollers 14, 16 about which is tightly wrapped a cylindrical belt 20. The frame has a base plate 22 with spaced apart upstanding side plates 24, 26. The assembly is oriented with a belt motion axis 30 having a down-feed direction 32 and an up-feed direction 34; a roller axis 40 having a first side direction 42 and a second side direction 44; and a vertical axis 50, with an upward direction 52 and a downward direction 54. These axes and directions are given to provide a frame of reference for clarity of illustration; in practice, the assembly may be oriented in any manner needed.

The first roller 14 is oriented parallel to the roller axis 40, and spans between plates 24 and 26 at an up-feed direction end of the plates. Each end of the roller 14 is supported at a fixed bearing point on a plate to provide low friction rolling motion without translation. The second roller 16 is supported at the same elevation above the frame plate as the first roller, at the opposite ends of the side plates, in an orientation nominally parallel to the first roller.

Each end of the second roller is slightly movable through a constrained path and spring biased to provide adjustability of the roller spacing and to provide tension in the belt. A first roller end 60 extends in the second direction 44, and is supported by a bearing point of a tension plate 62 that is slidably mounted to the frame plate 26 for constrained reciprocation along the belt motion axis 30. A tension spring 64, shown symbolically in the illustration, provided a spring bias force between the tension plate and the frame so that the roller end 60 is biased away from the first roller 14. Although shown as a tension spring, in the preferred embodiment a compression spring is employed. A drive motor 66 is mounted to the tension plate, and is engaged to the end 60 of roller 16 to drive the roller and belt. Normally, the motor operates to drive the upper span of the belt in the down feed direction as shown.

A second end 70 of the second roller 16 is mounted by way of an arm or crank element 72 mounted to the side plate 24. The crank is pivotally connected at a pivot point 74-that is generally centrally located on the crank. A first arm portion 76 extends to a roller support bearing point 80 that receives the end of the roller. A second arm portion 82 extends to a spring connection point 84, to which one end of a tension spring 86 is connected. The opposite end of the spring 86 is connected to the frame to generate torque on the crank depending on the crank position. The crank arm 72 has an angled profile, with the arms angled in a dog-leg or boomerang shape. This permits motion of the roller support end in a different direction than the direction of spring tension.

Figure 2:
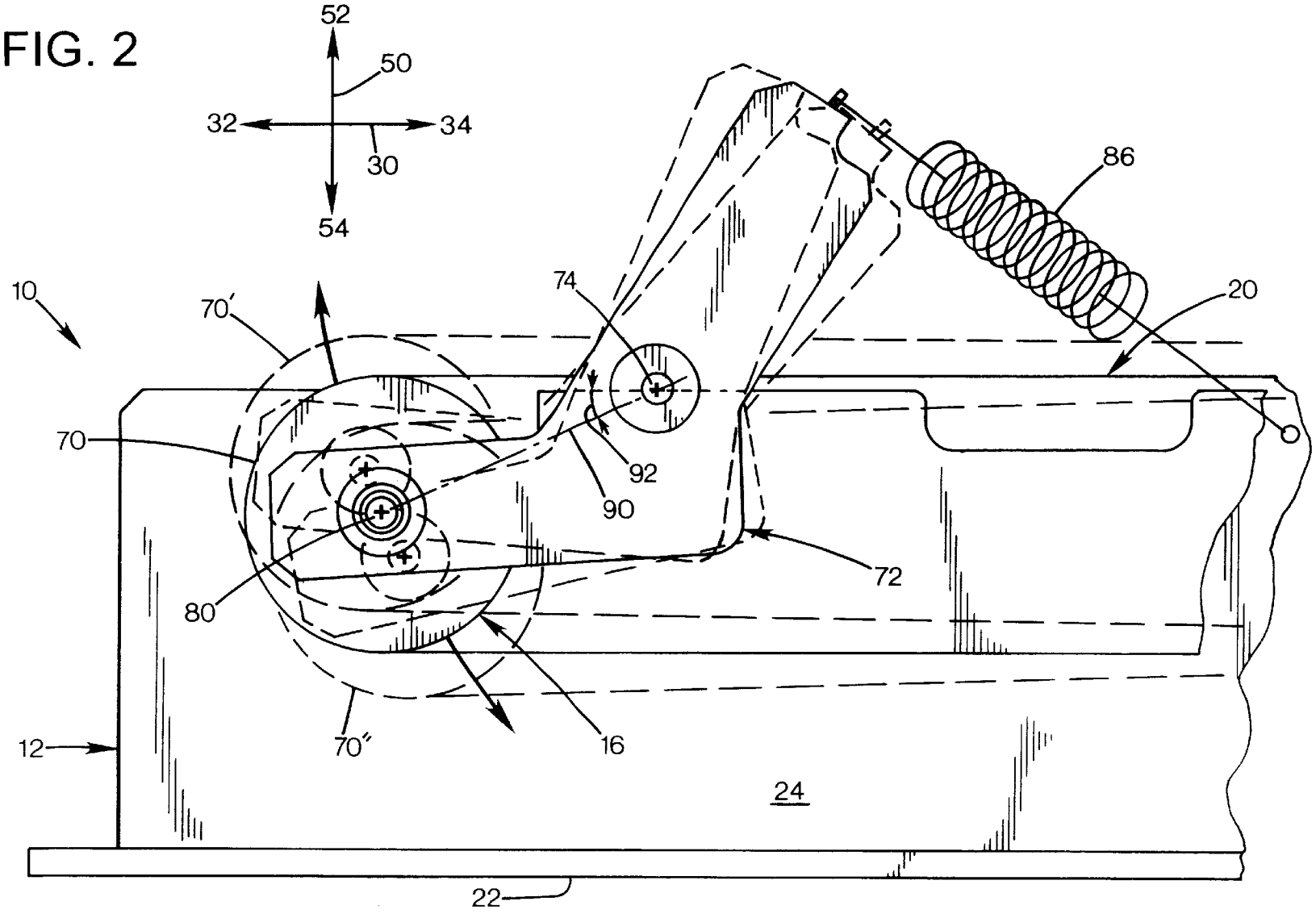
FIG. 2 is an enlarged side view of a belt assembly according to the preferred embodiment of the invention.

FIG. 2 shows a side view of the pivot arm 72 as attached to the frame 12. The arm is shown in three positions. In nominal position 72 (solid lines) it positions the roller 16 in a level orientation, parallel to roller 14. Spring 86 provides adequate tension to tension the associated edge portion of the belt 20, comparable to the tension generated by the opposed tension spring 64 discussed above. Due to the geometry of the arm 72 and leverage provided, the spring constant of spring 86 need not be a great as that of spring 64 to generate balanced belt tension from each roller end.

In response to decreased belt tension at the near belt edge, the arm 72 rotates slightly clockwise to bring the roller end 70 to an elevated position 70', as the spring 86 adjusts to a shorter extension and decreased tension to balance the belt tension. In response to increased belt tension at the near belt edge, the arm 72 rotates slightly counter-clockwise to bring the roller end 70 to a lowered position 70", as the spring 86 adjusts to a longer extension and increased tension to balance the belt tension. An infinite range of intermediate positions are possible, with the position of the roller end 70 being proportionate to the tension in the belt at that end. The movement of the roller end out of the nominal position in a direction having a component out of the plane of the upper belt plane is described as a "skewing" movement. A skewing movement takes the roller axes out of a common plane.

Nominally, the force generated by the belt tension at each roller end is equal, as is expected when the belt is properly centered on the roller, with an equal gap of exposed roller showing on each roller end. However, if the belt shifts to one end of the roller, the force borne by that roller end will exceed that borne by the opposite end. This relative force imbalance generates the rotational shift of the support arm 72, and the degree of shift is proportionate to the force difference, and thus to the belt offset.

The effect of the roller end elevation change or skewing is to shift the belt back to a more centered position. This skewing of rollers by shifting one out of a common plane produces a slight change in the wrap angle between the belt and the roller that shifts the belt. For instance, when the belt has shifted away from the roller end 70, and the reduced force allows the spring 86 to elevate the end 70 to position 70', the slight change in wrap angle that is produced by the rollers that are out of a common plane causes the belt to wind around the roller toward the roller end 70. In response to this shift, the belt tension on end 70 increases, lowering end 70, and easing and stopping the lateral shifting effect. Similarly, the effect of a belt shift in the opposite direction is to lower the roller end to position 70", which leaves the opposite roller end 60 in a relatively elevated position (i.e. less depressed), drawing the belt back in that direction. The effect of this system is not limited to correcting such large offsets, but to generate stability. For instance, if the roller diameter, belt circumference, or other dimensions were not perfectly nominal, the system might operate with the roller end 70 slightly shifted from the nominal position, at a stable equilibrium belt position that is not centered, but is within tolerable limits. The system is designed so that there is a damping effect that avoids overshooting, overcompensation, or cyclical periodic shifting or wavering of the belt. Geometry of the arm pivot points and lever arms may be varied for different needs, to ensure against over- and under-correction.

In the preferred embodiment, the roller 16 has a diameter of 2.5", and a length of 13.5". At the roller end 70, in the nominal position, the roller axis 80 is laterally offset from the pivot point 74 by 2.45", vertically offset by 1.1", for a radial distance of 2.7". A line 90 connecting the roller axis and the pivot point is angled by 24 degrees from the upper belt plane, so that the roller moves through a path that is similarly inclined from the vertical (i.e., the line connecting the roller axis and the point of tangency between the incoming belt and the roller) at small shift amounts. The radial distance between the pivot point 74 and the spring attachment point is 3". The spring has a tension of 29.6 pounds when in the nominal position, and has a spring constant of 14.4 pounds per inch. The tension spring 64 has a nominal tension of 80.2 pounds, and a spring constant of 120 pounds per inch. The spacing between the rollers is 12". In normal operation, the belt is driven at a speed of 10 inches per second.

The preferred embodiment is shown in terms of a simple system having only two equally sized rollers. In practice, the concepts disclosed herein are suitable for systems in which the rollers are of different sizes, or where more then two rollers provide a more serpentine belt path. It is believed that the plane of the belt approaching the skewable roller is an important geometric reference for the shifting of the roller end. In the illustrated example, the angles are as noted above. A range of angles may usefully be employed, with the angle 92 ranging between the possible extremes of 0 and 90 degrees. Near those extremes, friction must approach zero, so the angle preferably at an intermediate value somewhat offset from 0 and 90 degrees. For any given system, an optimum angle would be found.

Figure 3:
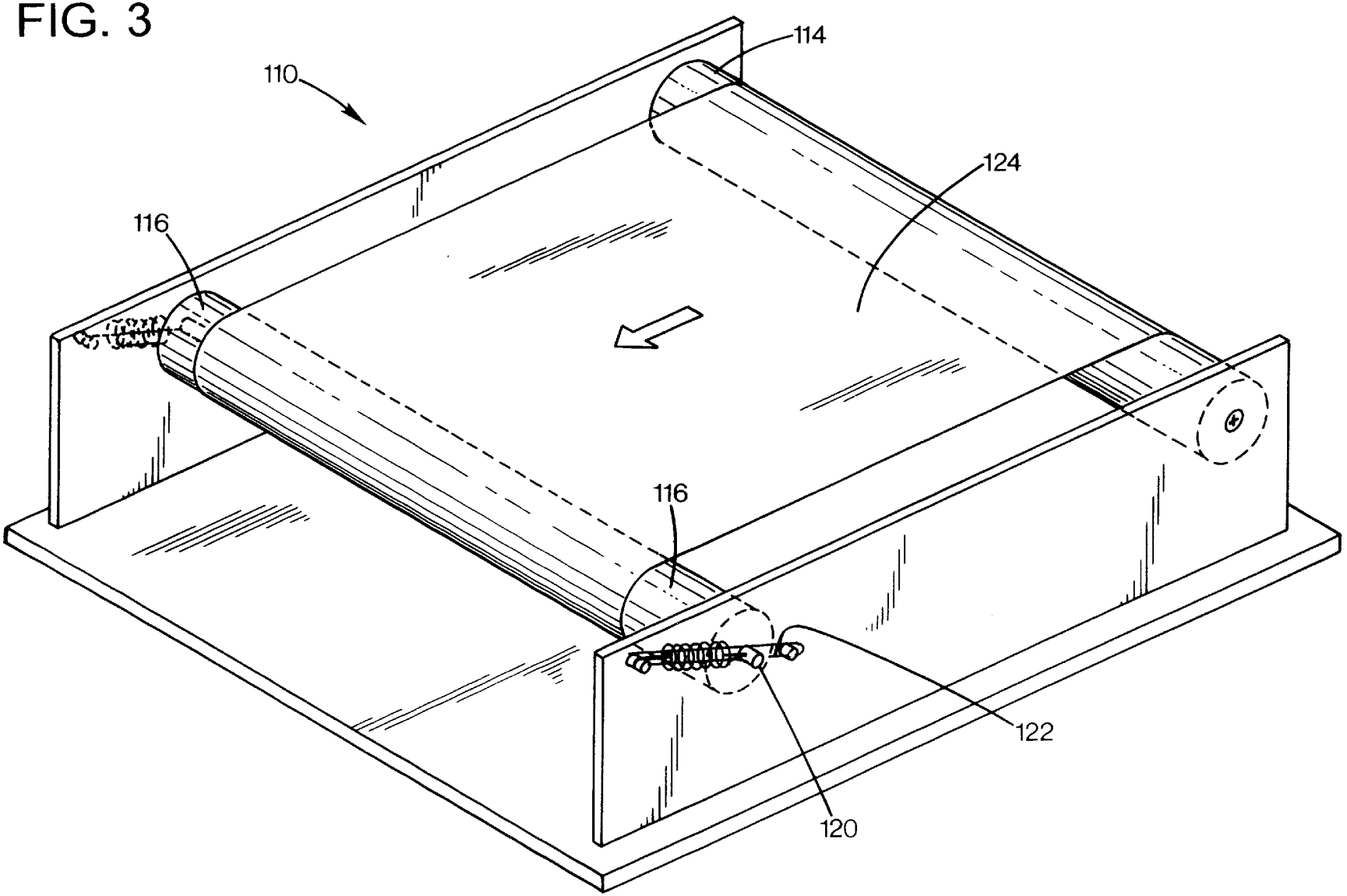
FIG. 3 is a perspective view of a belt assembly according to an alternative embodiment of the invention.

FIG. 3 shows an alternative belt assembly 110, with a fixed roller 114 and movable roller 116. Instead of the curved path at the roller end generated by the pivot arm, the roller 166 is constrained to a straight path, with an axis pin 120 constrained in a straight slot 122 that is oriented at an angle with respect to the upper surface of the belt 124. Although not essential, a comparable slot arrangement is provided at the opposite end of the roller 1 16, so that the same stabilizing and self centering function may be achieved by less extreme geometries. By limiting the angle of offset, the friction forces of the pin in the slot are reduced. In such an embodiment, the slot angle with respect to the belt upper surface is preferably in the range of 0 to 90 degrees. Again, the angle is dependent on the frictional characteristics at various component interfaces, desired belt tension, spring loads and damping levels of a specific system, The invention is particularly useful in the area of media transport in the printing industry. As media is transported through a printing or imaging system, motion perpendicular to the transport direction results in misrepresentation of the desired image on the medium. For an indexing system, such as a scanning-head inkjet printer, perpendicular motion can result in the misalignment of successive swaths of image—a print defect which is often noticeable and/or unacceptable to customers of printed media.

While the above is discussed in terms of preferred and alternative embodiments, the invention is not intended to be so limited.

What is claimed is:

1. A media transport belt assembly, comprising:

a first roller having opposed first and second ends;

a second roller;

a continuous belt encompassing at least the first and second roller; and a belt stabilizing mechanism which shifts the belt along the first roller into a stable equilibrium position without actively sensing belt offset, the belt stabilizing mechanism comprising:

a first tension mechanism coupled to the first end of the first roller allowing movement of the first end along a fixed linear path, and generating a first tension force which acts;.on the first roller in a first fixed direction parallel to the fixed linear path; and a second tension mechanism coupled to the second end of the first roller, comprising a spring and an arm, the arm coupled to the second end and to the spring, the spring being anchored, the arm having a pivot point, the arm rotating about the pivot point to balance a second tension force and a spring force, the second tension force applied along a moment-arm from the second end, wherein when the belt is in disequilibrium along the first roller, the second tension force defines a moment arm countering the first tension force in proportion to the disequilibrium of the belt, skewing the first roller relative to the second roller causing the belt to shift gradually along the first roller toward the stable equilibrium position.

2. A media transport assembly according to claim 1, wherein the first tension force and second tension force al-e equal while the belt is in the stable equilibrium position.

3. A media transport assembly according to claim 1, wherein when the belt is offset away from the stable equilibrium position, uneven tension is exerted by the belt along the first roller causing the first tension force to be in disequilibrium relative to the second tension force, the first tension mechanism and the second tension mechanism altering, respectively, the first tension force and the moment arm in response to said disequilibrium to skew the first roller relative to the second roller causing the belt to shift gradually along the first roller toward the stable equilibrium position.

4. A media transport assembly according to claim 1, further comprising a frame to which the second roller is connected, and wherein the pivot point about which the arm rotates is connected to the frame.

5. A media transport assembly according to claim 1, wherein the first tension force acts in a first fixed direction, and the moment arm defines an acute angle relative to the first direction to cause self-adjustment of belt position.

6. A media transport assembly according to claim 1, in which the second end of the first roller is movable along a constrained path.

7. A media transport assembly according to claim 1, in which the first end of the first roller is movable along a constrained path.

8. A media transport belt assembly, comprising:

a first roller; a second roller; a belt encompassing at least the first roller and the second roller, a first end of the first roller constrained to move along a fixed linear path;

means for generating a first tension force at a first end of the first roller in a direction parallel to the fixed linear path;

means for generating a second tension force at a second end of the first roller, wherein a variation between the first tension force and second tension force is attributable to disequilibrium of belt position along the first: roller; and means for shifting the belt along the first roller out of disequilibrium into a stable equilibrium position without actively sensing belt offset by concurrently applying the first tension force and the second tension force, the second tension force inducing a moment on the second end proportional to said disequilibrium.

9. A method of operating a media transport mechanism, comprising:

generating a first tension force at a first end of a first roller, the first roller constrained to move along a fixed linear path responsive to the first tension force;

generating a second tension force at a second end of the first roller, wherein a variation between the first tension force and second tension force is attributable to disequilibrium of belt position along the first roller of a belt encompassing the first roller and at least one other roller;

shifting the belt along the first roller out of disequilibrium into a stable equilibrium position without actively sensing belt offset by concurrently applying the first tension force and the second tension force, the second tension force inducing a moment on the second end proportional to said disequilibrium.

10. A method according to claim 9, wherein said shifting further comprises skewing the second end along an arc.

* * * * *

UNITED STATES PATENT AND TRADEMARK OFFICE

CERTIFICATE OF CORRECTION

PATENT NO. : 6,457,709 B1
DATED : October 1, 2002
INVENTOR(S) : Madsen et al.

It is certified that error appears in the above-identified patent and that said Letters Patent is hereby corrected as shown below:

Column 3,
Line 34, “effect. Similarly,” should read -- effect. Similarly --;

Column 4,
Line 56, “acts;. on the” should read -- acts on the --;

Column 5,
Line 7, “al-e” should read -- are --.

Signed and Sealed this

Thirteenth Day of July, 2004

JON W. DUDAS
*Acting Director of the United States Patent and Trademark Office*